US007849848B2

(12) United States Patent
Catalina

(10) Patent No.: US 7,849,848 B2
(45) Date of Patent: Dec. 14, 2010

(54) ERECTABLE AND STOWABLE DECORATIVE FIREBOWL AND STAND ASSEMBLY

(76) Inventor: Jay Catalina, 10070 High Falls Pointe, Alpharetta, GA (US) 30022

( * ) Notice: Subject to any disclaimer, the term of this patent is extended or adjusted under 35 U.S.C. 154(b) by 1149 days.

(21) Appl. No.: 11/439,188

(22) Filed: May 24, 2006

(65) Prior Publication Data

US 2007/0001068 A1 Jan. 4, 2007

Related U.S. Application Data

(60) Provisional application No. 60/686,922, filed on Jun. 3, 2005.

(51) Int. Cl.
*F24C 1/16* (2006.01)
*A47J 37/07* (2006.01)

(52) U.S. Cl. ..... 126/304 A; 126/304 R; 126/25 R; 126/9 B; 126/26; 248/150

(58) Field of Classification Search ..... 126/304 A, 126/304 R, 26, 25 R; 248/150
See application file for complete search history.

(56) References Cited

U.S. PATENT DOCUMENTS 4,131,261 A * 12/1978 Shy ..... 248/439
4,210,118 A * 7/1980 Davis et al. ..... 126/25 R
4,553,524 A * 11/1985 Wheat et al. ..... 126/25 R
5,179,932 A * 1/1993 DeCarlo ..... 126/9 R
5,315,983 A * 5/1994 Law ..... 126/216
5,832,915 A * 11/1998 Skidmore et al. ..... 126/9 R
5,960,788 A * 10/1999 Bach et al. ..... 126/506
6,755,188 B2 * 6/2004 Skidmore et al. ..... 126/25 R

* cited by examiner

*Primary Examiner*—Steven B McAllister
*Assistant Examiner*—Nikhil Mashruwala
(74) *Attorney, Agent, or Firm*—Stites & Harbison PLLC; Jeffrey A. Haeberlin

(57) ABSTRACT

A firebowl assembly is provided which includes a firebowl and a stand for the firebowl. The stand has a first, erected mode wherein the stand supports the firebowl and a second, folded mode wherein the stand is adapted to be received within the firebowl for storage therein. The stand includes a support ring for supporting the firebowl in the first state of the stand and a plurality of legs pivotably connected to the ring and pivotable between (i) an erected state in the first mode of the stand and (ii) a folded state in the second mode of the stand.

3 Claims, 22 Drawing Sheets

ERECTABLE AND STOWABLE DECORATIVE FIREBOWL AND STAND ASSEMBLY

CROSS REFERENCE TO RELATED APPLICATIONS

This application claims benefit of U.S. Provisional Application No. 60/686,922, filed Jun. 3, 2005 (which is hereby incorporated by reference).

FIELD OF THE INVENTION

The present invention relates to decorative firebowls, which are supported on a stand during use, and, more particularly, to a decorative firebowl and stand assembly which is readily assembled and which can be stored as a compact unit.

BACKGROUND OF THE INVENTION

The use of ornamental or decorative firebowls, i.e., firebowls not used for cooking purposes, is increasing in popularity. The firebowl is typically a separate element from the stand on which the firebowl rests in use. When not in use, the firebowl and stand are generally stored away out of sight. One disadvantage of current constructions is that the firebowl and the stand for the firebowl take up a substantial amount of space when they are stored away. Moreover, being separate units, they can become separated from each other when stored with other items, and one or the other can be temporarily misplaced or otherwise be difficult to find when it is desired to use the assembly again.

SUMMARY OF THE INVENTION

In accordance with embodiments of the invention, there is provided a decorative firebowl and stand assembly which overcomes the problems of the prior art described above. According to an important feature, the stand is stowable within the firebowl when the firebowl is not in use so that the firebowl and stand can be stored away as a unit. A major advantage of the stowable feature of the assembly is the easy portability thereof, thus making the assembly easy to take to the beach, and to use in camping and tailgating. Further, as will appear, essentially no assembly is required and no tools are needed.

According to one aspect of the invention, there is provided an erectable and stowable decorative firebowl and stand assembly comprising:

a firebowl; and a stand having a first, erected state wherein the stand supports the firebowl and a second, folded state wherein the stand is adapted to be received within the firebowl, said stand including a support ring for supporting the firebowl in the first state of the stand, a plurality of legs pivotably connected to the ring and pivotable between (i) an erected state in the first state of the stand and (ii) a folded state in the second state of the stand, and a control mechanism for controlling pivoting of the legs.

In some preferred embodiments, the control mechanism comprises a support member having a plurality of arms equal in number to the number of said legs, a slider slidably mounted on each of said arms and pivotably connected to a respective one of said plurality of legs, and a locking mechanism associated with each said slider and respective arm for controlling (i) locking of the slider relative to the respective arm so as to prevent pivoting of the corresponding leg, and (ii) releasing of the slider from the respective arm so as to enable pivoting of the corresponding leg.

In one preferred embodiment, the locking mechanism comprises a spring-loaded plunger mounted on each said arm.

In another preferred embodiment, the locking mechanism comprises a releasable clamp device. Preferably, the clamp device comprises a cylindrical clamp located at a free end of each said arm and adapted to engage the associated slider, each said clamp including a control element for controlling tensioning of the clamp.

In some preferred embodiments, the support member comprises a cross member. In one implementation, the cross member comprises four arms of rectangular cross section. In another implementation, the cross member comprises four arms of circular cross section.

In another preferred embodiment, the control mechanism comprises a support member including a plurality of arms equal in number to the number of said legs, each said arm including a longitudinal slot therein, and said legs each including a connector member having a free end portion received in the slot of an associated arm.

Preferably, the support member comprises a cross member comprising four said arms, each said arm including a said slot extending along an underside thereof, and said free end portion comprising a headed end received in a corresponding said slot.

In other preferred embodiments, the control mechanism includes a latch for releasably latching the legs to the ring so as to prevent pivoting movement of the legs. Preferably, the latch comprises a pivotable latch arm movable between a first, latching position and a second, inoperative position.

Advantageously, the ring includes a depending mounting plate and wherein said latch arm is mounted on the mounting plate.

In one preferred implementation of these embodiments, the mounting plate includes a U-shaped support element including a mounting portion, and the latch arm is pivotably mounted at one end thereof to said mounting portion.

In another preferred implementation of these embodiments, each leg comprises a transverse latching bar, and each said latch arm comprises a resilient pivotable U-shaped latching member for releasably engaging an associated said latching bar so as to prevent pivoting of the associated leg.

In accordance with a further aspect of the invention, there is provided in combination, a decorative firebowl and a stand for the firebowl, the stand having a first, erected state wherein the stand supports the firebowl and a second, folded state wherein the stand is adapted to be received within the firebowl, and said stand including a support ring for supporting the firebowl in the first state of the stand, and a plurality of legs pivotably connected to the ring and pivotable between (i) an erected state in the first state of the stand and (ii) a folded state in the second state of the stand.

In some preferred embodiments, the stand further comprises a support member having a plurality of arms equal in number to the number of said legs, a slider slidably mounted on each of said arms and pivotably connected to a respective one of said plurality of legs, and a retention mechanism associated with each said slider and respective said arm for controlling (i) retention of the slider against movement thereof relative to the respective arm so as to prevent pivoting of the corresponding leg, and (ii) releasing of the slider from the respective arm so as to enable pivoting of the corresponding leg.

In another preferred embodiment, the stand further comprises a support member including a plurality of arms equal in number to the number of said legs, each said arm including a longitudinal slot therein, and said legs each including a connector member having a free end portion received in the slot of an associated said arm for movement along the slot during pivoting of the associated leg, said free end portion retaining the associated leg by friction in the erected state thereof when said end portion is disposed at the distal end of the associated slot.

In other preferred embodiments, the stand further includes a latch for releasably latching the legs to the ring so as to prevent pivoting movement of the legs.

According to another aspect of the invention, there is provided an erectable and stowable firebowl and stand assembly, said assembly comprising:

a firebowl; and a stand having a first, erected state wherein the stand supports the firebowl and a second, stowable state wherein the stand is adapted to be received within the firebowl for storage therewith, said stand including a support ring for supporting the firebowl in the first state of the stand, a plurality of legs pivotably connected to the ring and pivotable between (i) an erected state in the first state of the stand and (ii) a folded state in the second state of the stand, the ring being of a size relative to the firebowl so as to be fully accommodated within the firebowl in the second, stowable state of the stand.

Further features and advantages of the present invention will be set forth in, or apparent from, the detailed description of preferred embodiments thereof which follows.

DESCRIPTION OT THE PREFERRED EMBODIMENTS

Figure 1:
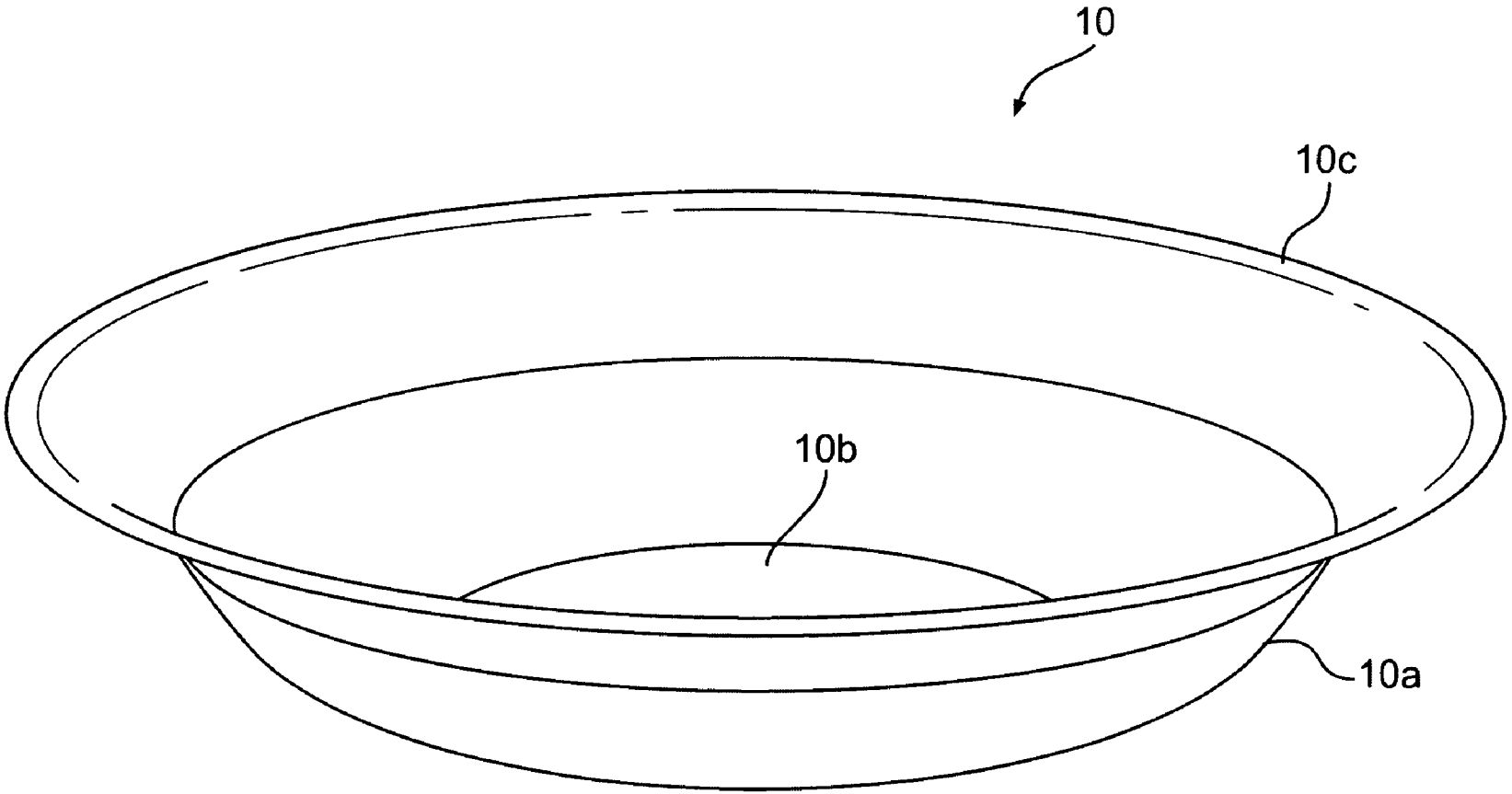
FIG. 1 is a perspective view of a decorative firebowl in accordance with one preferred embodiment of the invention.
Figure 2:
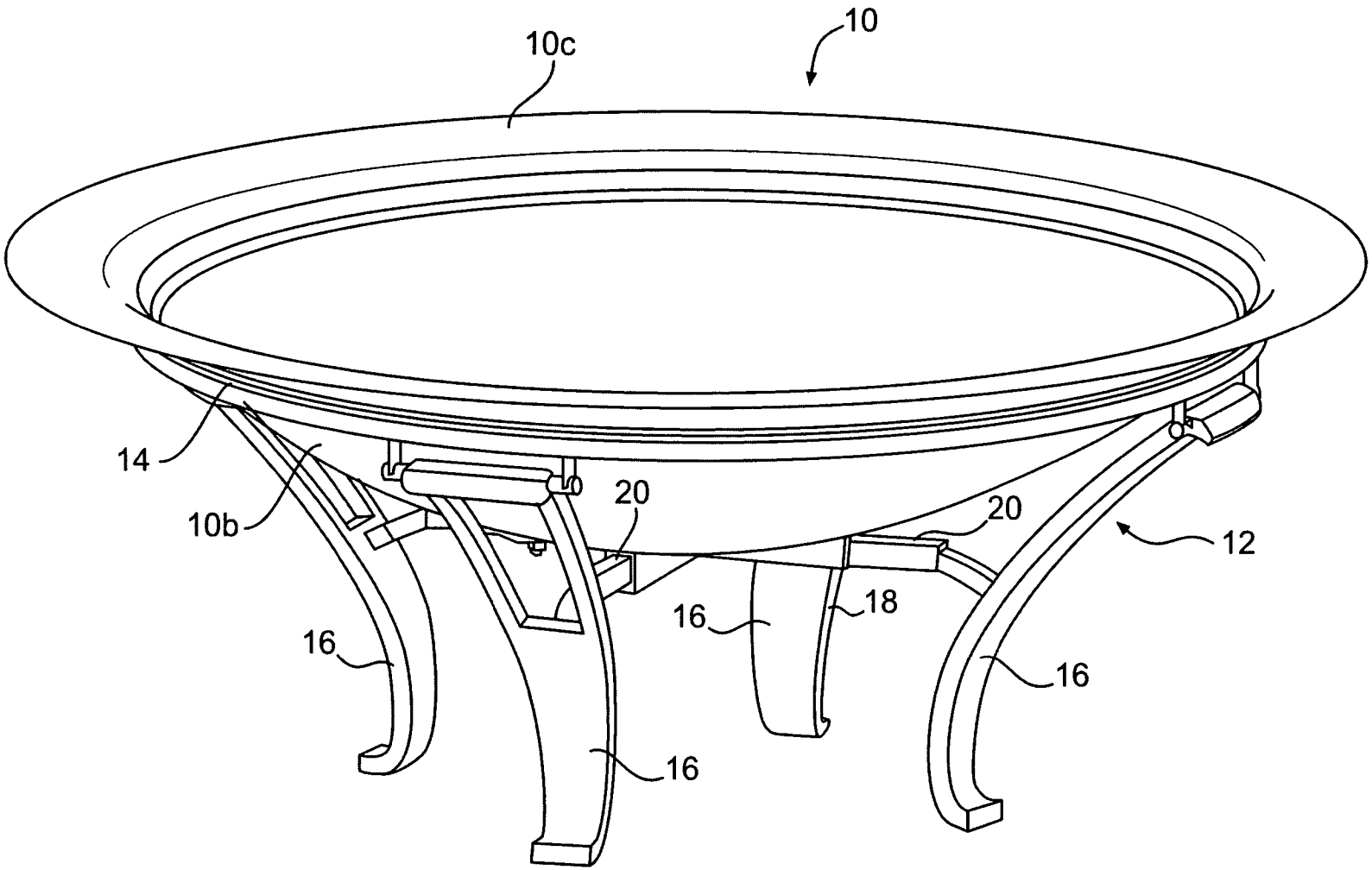
FIG. 2 is a perspective view of a firebowl and stand assembly in accordance with a preferred embodiment of the invention, in the operative state, and including the firebowl of FIG. 1.

Referring first to FIG. 1, there is shown a perspective view of a decorative firebowl or firebowl 10 which is constructed in accordance with a preferred embodiment of the invention and which forms part of the folding firebowl assembly, along with a support stand 12 shown in FIG. 2 and other figures. Firebowl 10 includes a bottom portion 10*a* having a flat bottom 10*b*, and an integral upper circumferential outwardly extending lip portion 10*c*. It will be understood that firebowl 10 can be of other shapes but, as will appear, firebowl 10 must be dimensioned relative to the stand 12 so as to be received in and supported by stand 12 in the operative mode of the assembly, and, in the inoperative or storage mode, to, itself, receive the folded stand 12 for storage firebowl 10.

Figure 3:
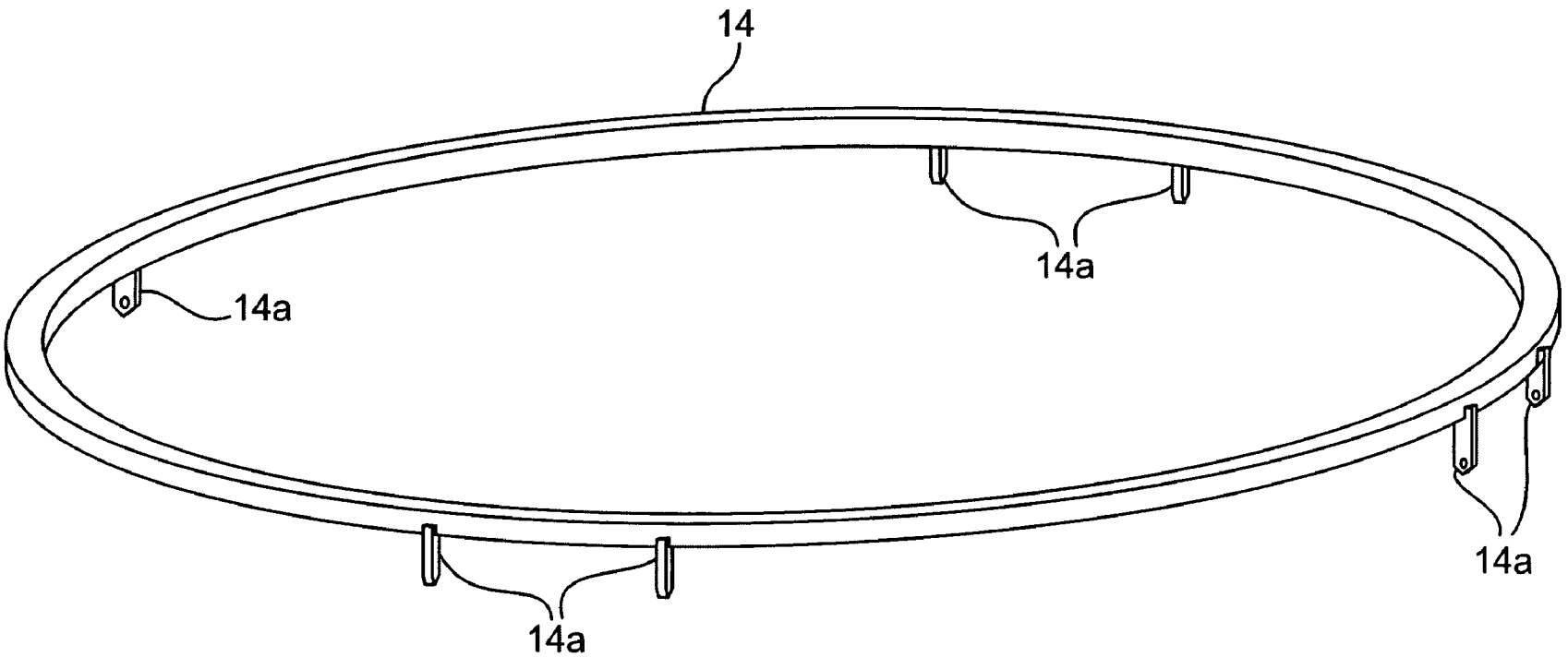
FIG. 3 is a perspective view of a ring member or ring of the stand of FIG. 2.

Referring to FIG. 2, there is shown a perspective view of the firebowl assembly in the operative mode or state. As illustrated, the support stand 12 includes a ring portion or ring 14 on which lip 10*c* of firebowl 12 rests. A perspective view of ring 14 is shown in FIG. 3 and, as illustrated, ring 14 includes four pairs of downwardly depending connector elements denoted 14*a* which include or, act as, pivot points, as described below.

Figure 4:
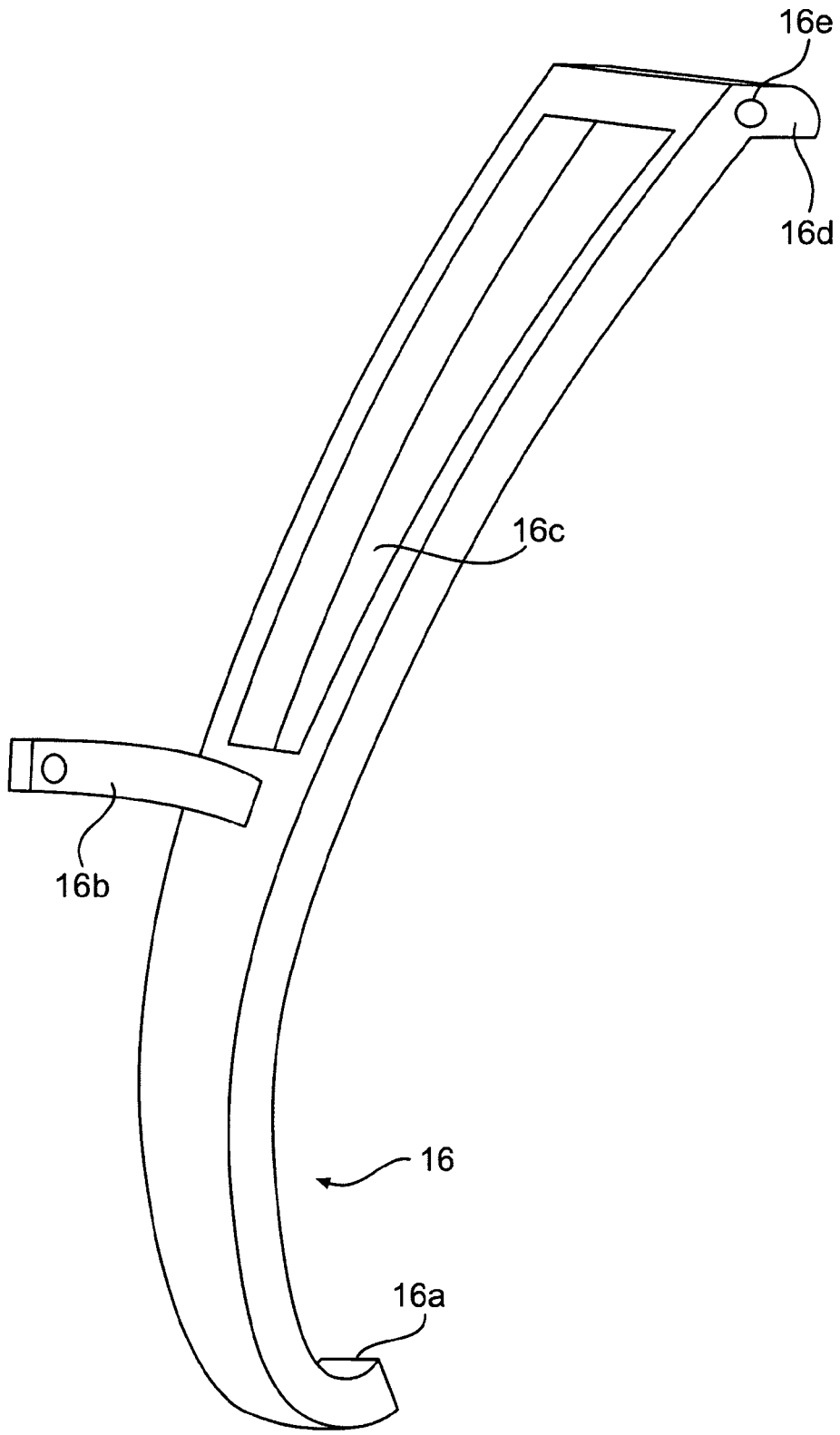
FIG. 4 is a perspective view of one of the legs of the stand of FIG. 2.

Stand 12 also includes a plurality of support legs 16. In this embodiment, four legs 16 are employed. A typical leg 16 is shown in FIG. 4 and, as illustrated, leg 16 includes a lower, curved ground engaging portion 16*a*, an outwardly extending, connector (support) element 16*b* located in an intermediate position therealong, an optional upper slotted or open portion 16*c*, and an upper end 16*d* including a pivot opening 16*e*.

Referring again to FIG. 2, stand 2 also includes a cross member 18 including four arms 18*a* and four slider members 20 (two of which are shown in FIG. 2) which are described in more detail below.

Figure 5:
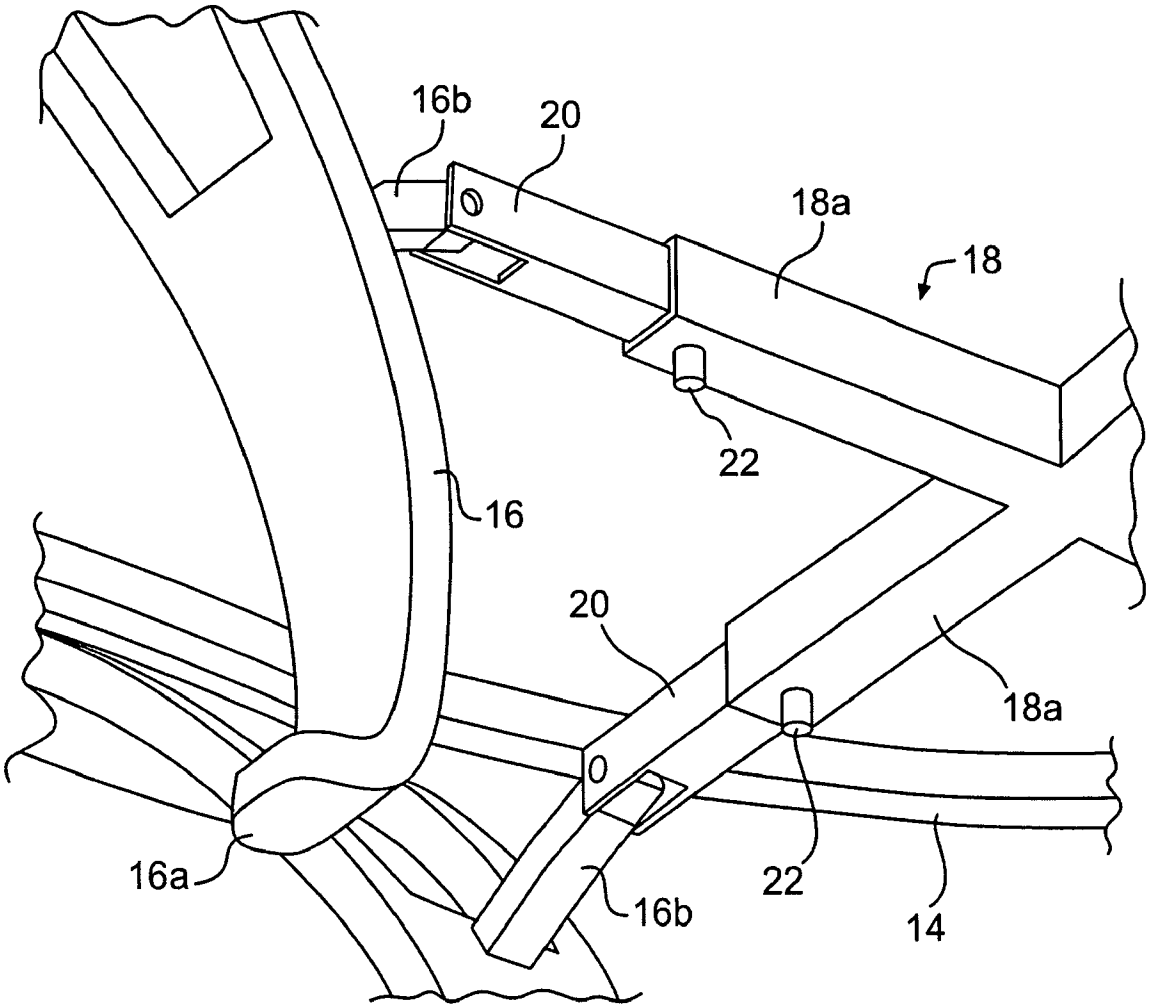
FIG. 5 is a partially broken away, perspective view from under the stand, showing details of the stand of FIG. 2.
Figure 6:
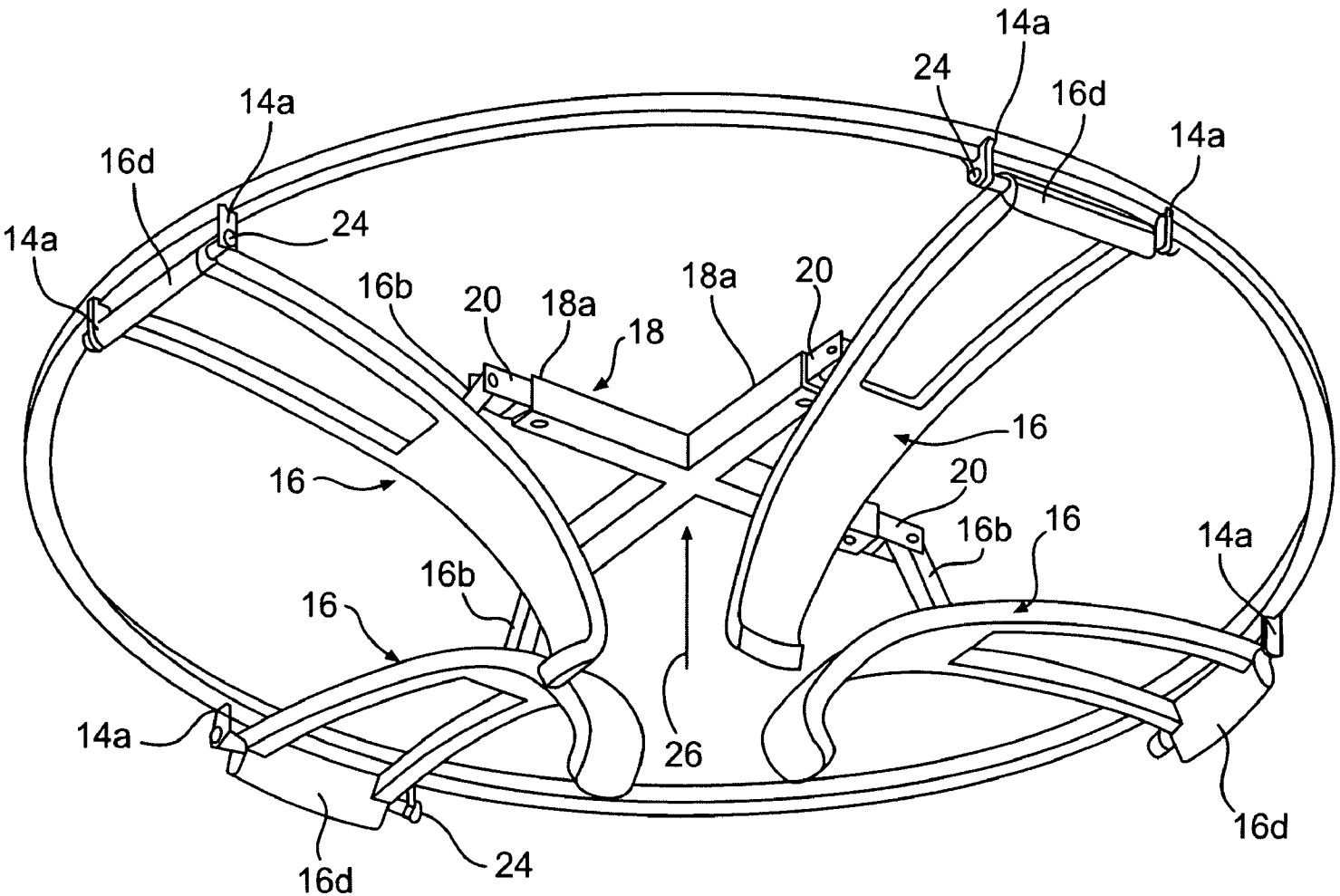
FIG. 6 is a perspective view from under the stand of the stand of FIG. 2, showing the legs in a position intermediate to the fully folded state thereof.
Figure 7:
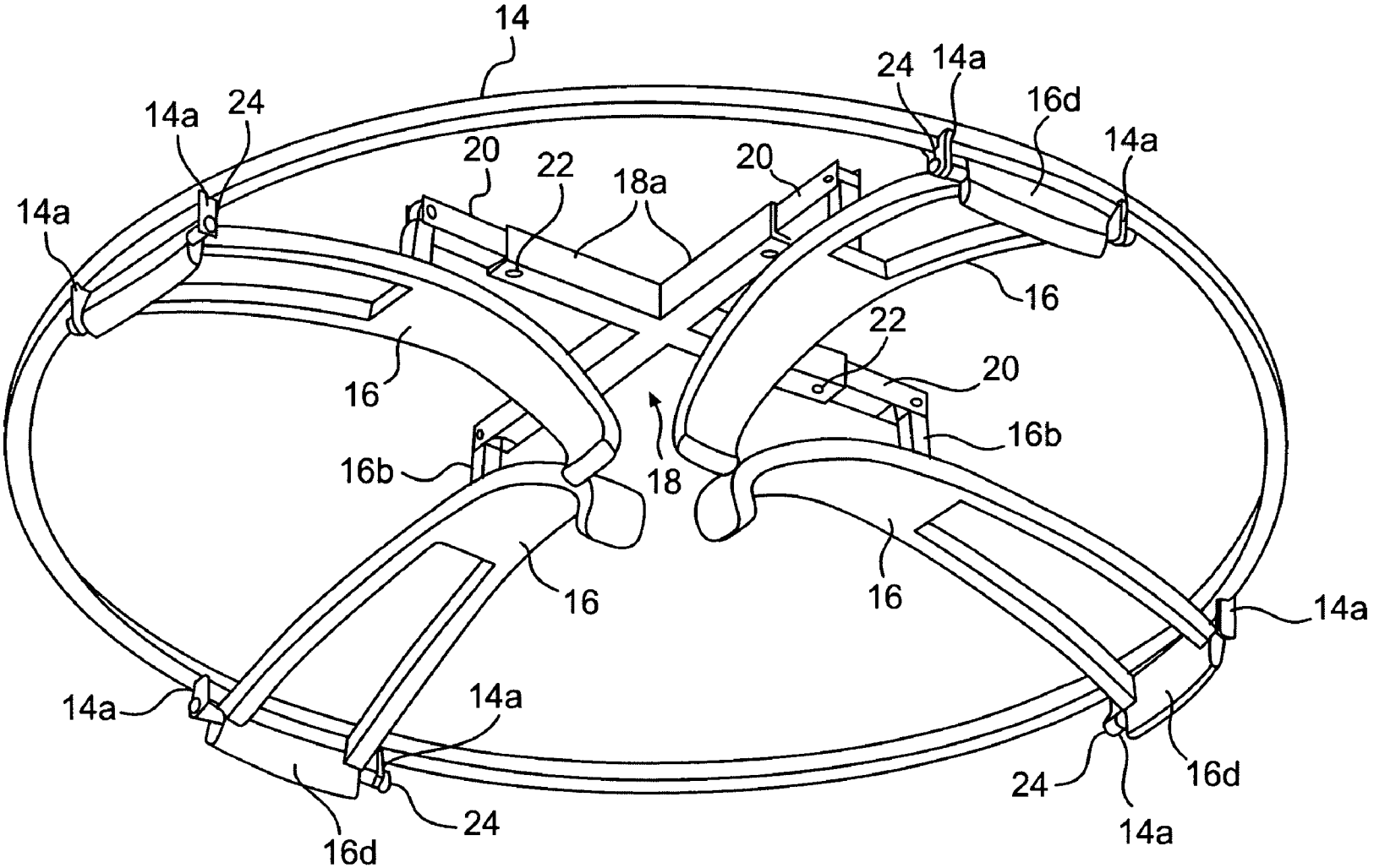
FIG. 7 is a perspective view similar to that of FIG. 6, showing the legs in the fully folded state thereof.

Referring to FIGS. 5 to 7, in the implementation illustrated, the four arms 18*a* of cross member 18 of a hollow rectangular shape, and one of the slider members or sliders 20 is received in each arm 18*a*. Sliders 20 are pivotably connected at the free ends thereof to corresponding connector elements 16*b* of an associated leg 16. A spring-loaded plunger 22 is provided on each arm 18*a* of cross member 18 and controls locking and release of the associated slider 20, so as to thereby control the movement of the associated slider 20. As indicated above, sliders 20 are pivotably connected to respective connector elements 16*b* of legs 16 and, similarly, the upper ends of legs 16 are pivotably connected to connector elements 14*a* of ring 14, using pivot pins or a pivot tube or rod 24 (see FIGS. 6 and 7) received in pivot openings 16*e* of legs 16.

In the operative or erected mode of the stand 12 shown in FIG. 2, and also illustrated in FIG. 3, sliders 20 extend fully outwardly from the corresponding arms 18*a* of cross member 18 and thus enable pivoting of legs 16 around connector elements 14*a* of ring 14 into an operative, upright state. Plungers 22 lock or hold sliders 20 in the extended position so that the stand 12 provides a sturdy, rigid base for firebowl 10.

To provide folding of stand 12 into the inoperative position thereof, the spring-loaded plungers 22 are depressed so as to release sliders 20, and thus legs 16, from the fixed and locked states thereof. This allows legs 16 to pivot around ring 14 (i.e., about the pivot provided by pivot pins 24) and about cross member 18 (about the pivot point provided between sliders 22 and connector elements 16*b*). During this pivoting movement, sliders 20 will recess into, i.e., be retracted into, arms 18*a* of cross member 18. This pivoting movement is illustrated in FIG. 6 wherein the arrow 26 shows the direction of movement (movement vector) of cross member 18.

In the folded and locked end positions of legs 16 shown in FIG. 7, plungers 16 are again seated in the corresponding openings in arms 16*a* of cross member 18, and legs 16 can no longer pivot. The folded and locked stand 12 is now ready to be placed in firebowl 10.

Figure 8:
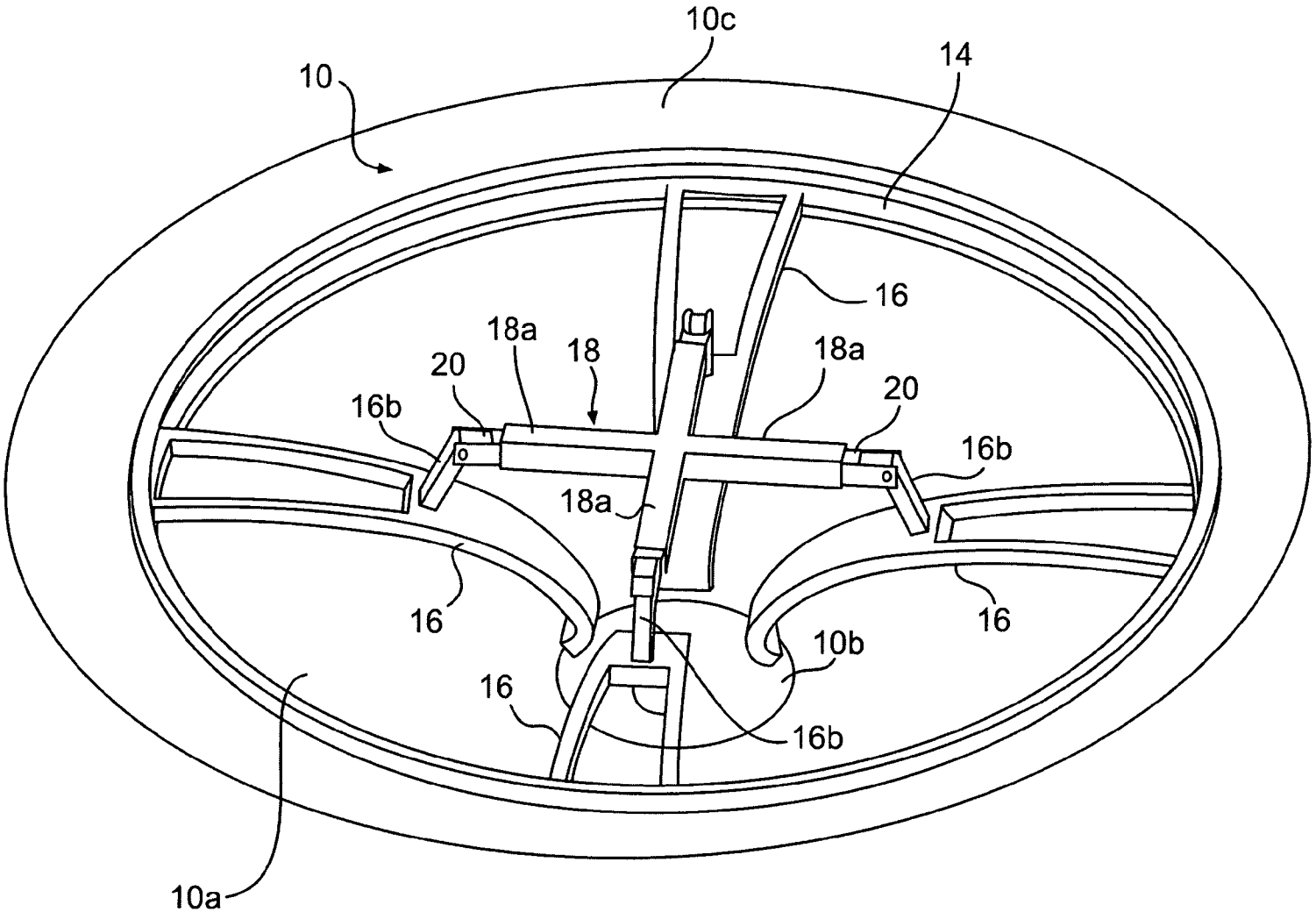
FIG. 8 is a top perspective view of the overall assembly showing the stand of FIGS. 2 to 7 received in the firebowl of FIG. 1.
Figure 9:
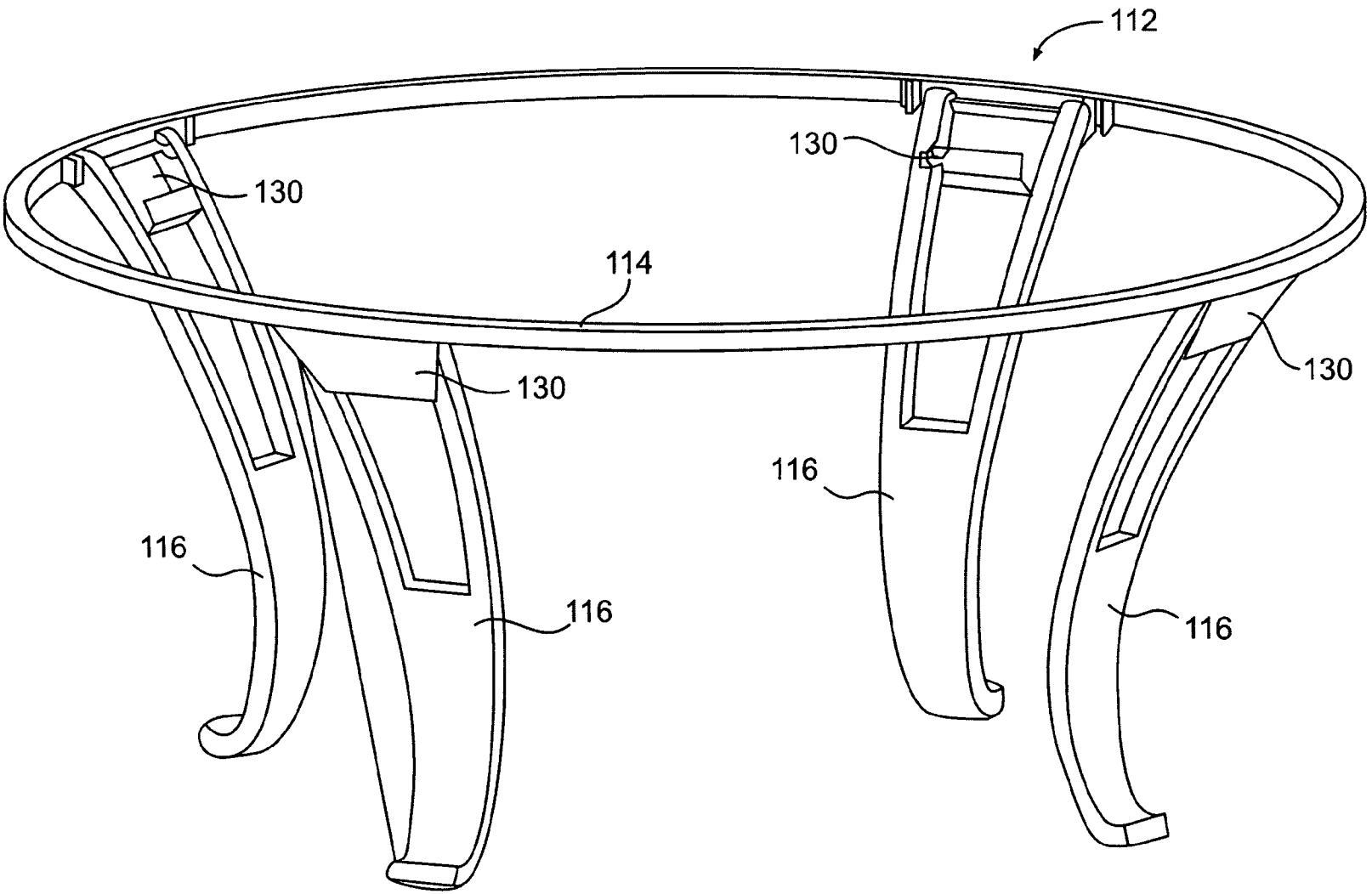
FIG. 9 is a perspective view of a stand in accordance with a further preferred embodiment of the invention, in the operative, erected state thereof.

Referring to FIG. 8, stand 12, in the folded and locked position, is shown received or stored within the confines of firebowl 10. As illustrated, ring 14 rests just below the top edge of firebowl portion 10*a* and below lip portion 10*c*. It will be appreciated that the ability to store stand 12 within firebowl 10 is one of the major advantages of the invention.

Referring to FIGS. 9 to 13, a further embodiment of the invention is shown. This embodiment has the advantage of being of simpler construction than that of FIGS. 1 to 8. The firebowl is the same and the basic stands of the two embodiments are similar, and thus like or corresponding elements in FIGS. 9 to 13 have been given the same reference numerals as in FIG. 1 to 8, preceded by a "1" so that the firebowl of FIGS. 9 to 13 is denoted 110 and the stand is denoted 112.

An important difference between the two embodiments is that, in the embodiment of FIGS. 9 to 13, the mechanism used to effect folding and locking of the legs 116 is carried by the legs 116 and the ring 114, and the cross member 18 of FIGS. 1-8 are eliminated. This mechanism, which is generally denoted 130 and which is described in more detail below in connection with FIGS. 10 to 12, enables movement of legs 116 between the operative erect position shown in FIG. 9 and the inoperative, stowed or folded position shown in FIG. 13.

Figure 10:
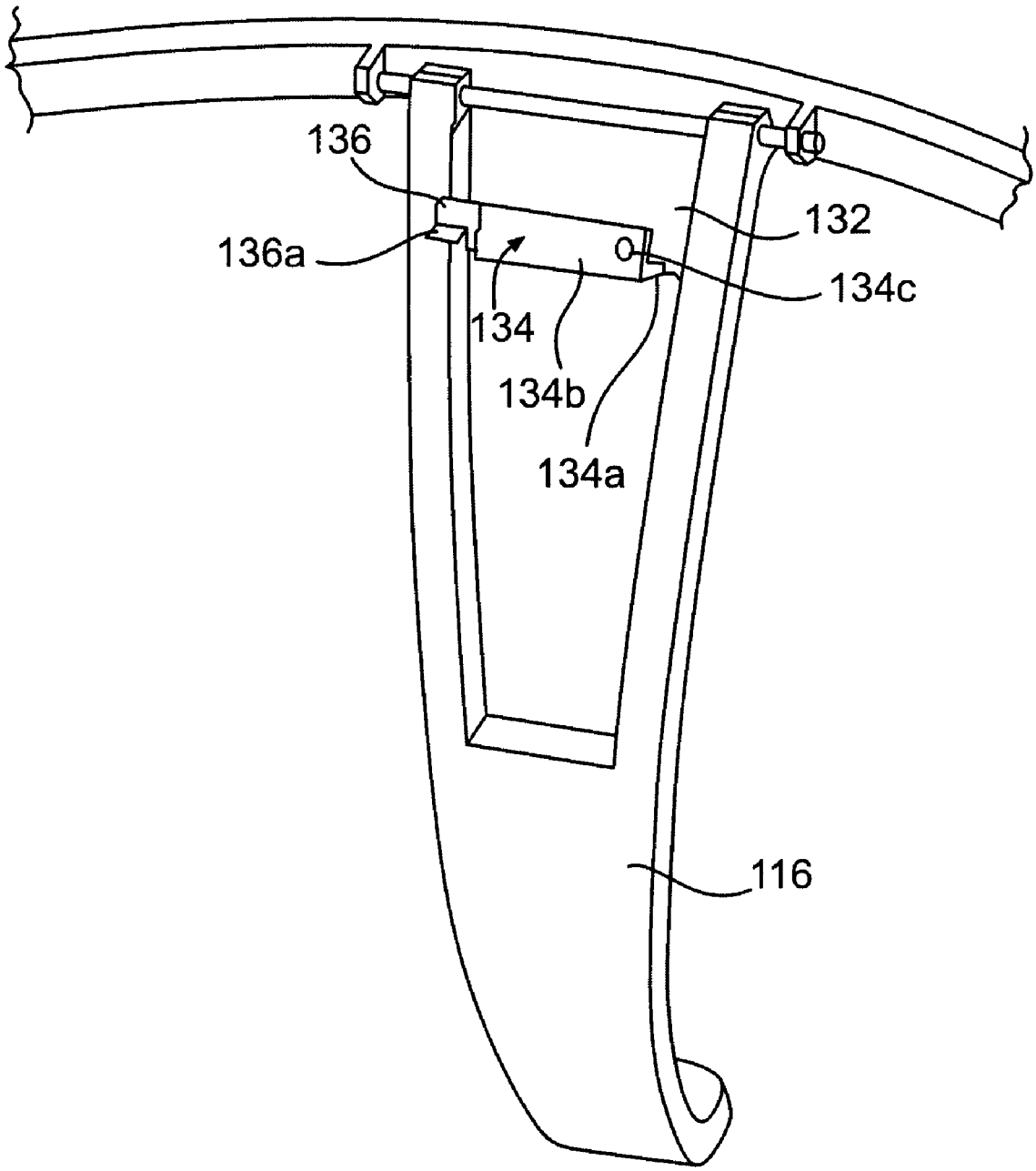
FIG. 10 is a partially broken away, perspective view, showing one of the legs of the stand of FIG. 9, in the operative, erected state.
Figure 11:
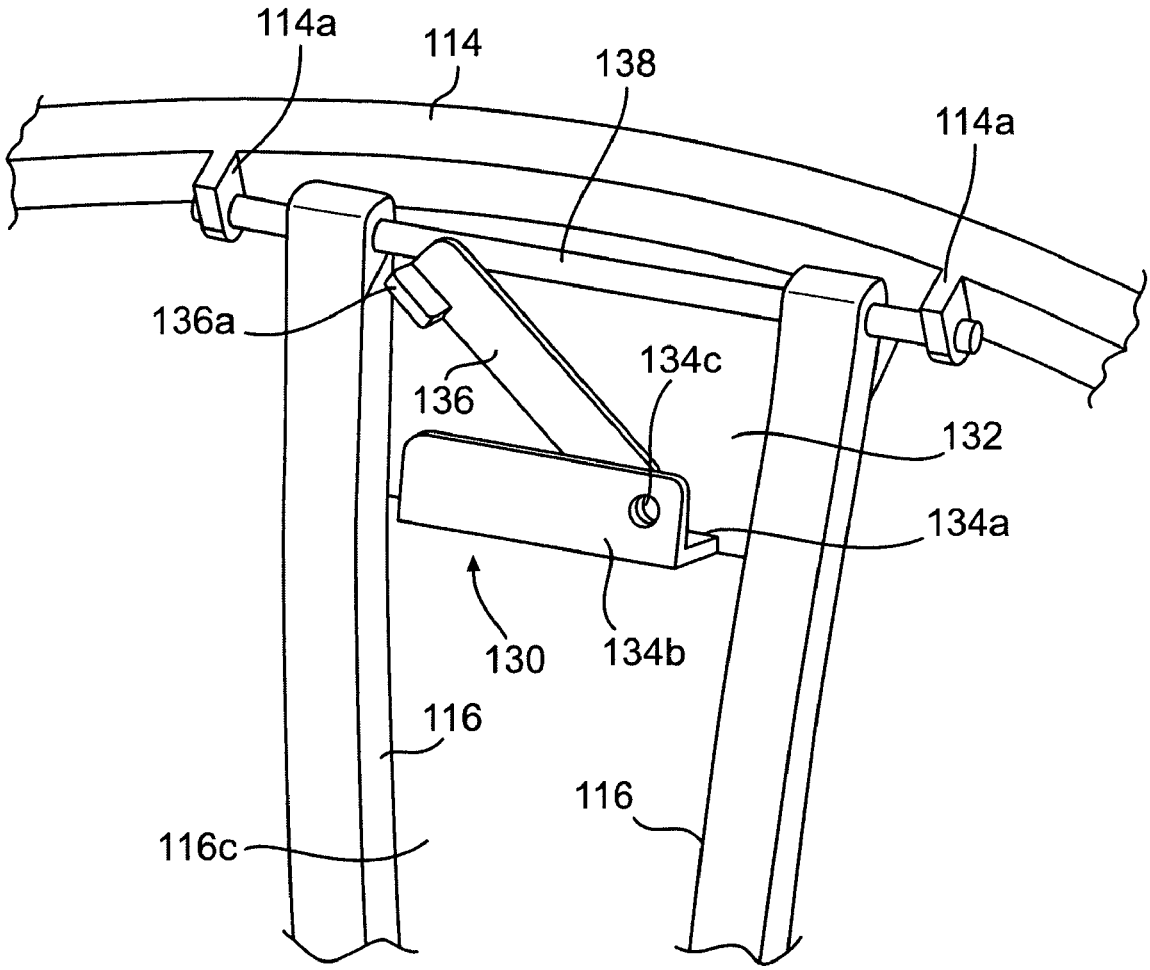
FIG. 11 is a partially broken away perspective view showing details of the latching mechanism of the leg shown in FIG. 10.
Figure 12:
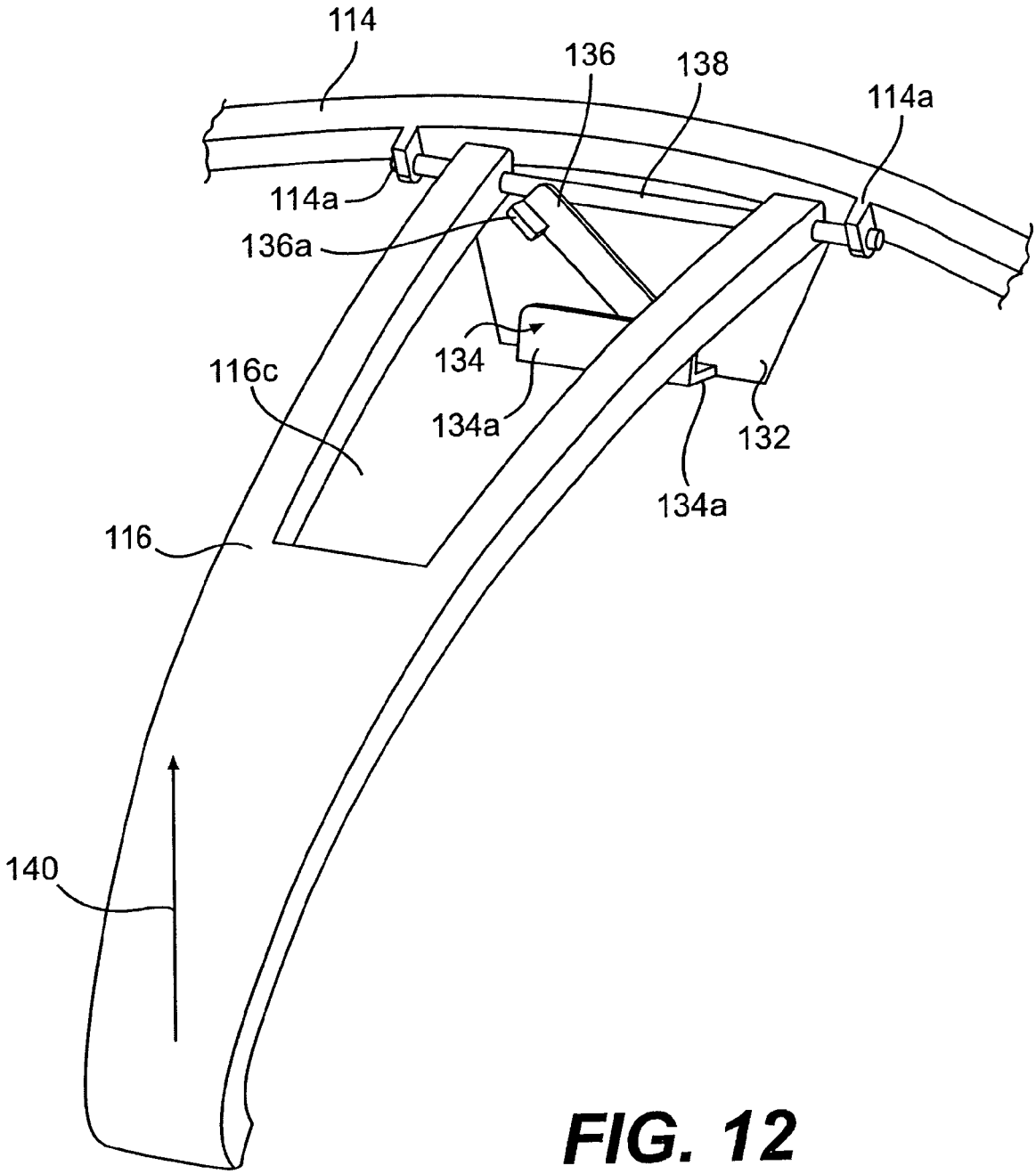
FIG. 12 is a partially broken away perspective view, showing the leg of FIG. 10 during movement thereof to the folded state.

Referring to FIGS. 10 to 12, and particularly to FIGS. 10 and 11, as illustrated, as part of mechanism 130, ring 114 includes a downwardly depending support plate 132 that mounts or carries an L-shaped support member or bracket 134 comprising a connecting portion 134*a* and mounting portion 134*b*. A pivotable latch 136, having a gripping element 136*a* at one end thereof, is pivotably mounted at the other end thereof to pivot about a pivot point 134*c* located at one end of mounting portion 134*b*. The legs 116 are pivotably mounted on ring 114 and pivot around a pivot tube or pivot rod 138 mounted between support elements 114*a*.

As shown in FIG. 10, with leg 116 in the upright or erected position thereof, latch 136 can be moved to engage a portion of the associated leg 116, and thus, latch or lock leg 116 in place. With latch 136 pivoted out of engagement with leg 116, and thus released from the latching position thereof, as illustrated in FIG. 11, leg 116 is free to pivot to a stowed position, as indicated by arrow 140 in FIG. 12.

Figure 13:
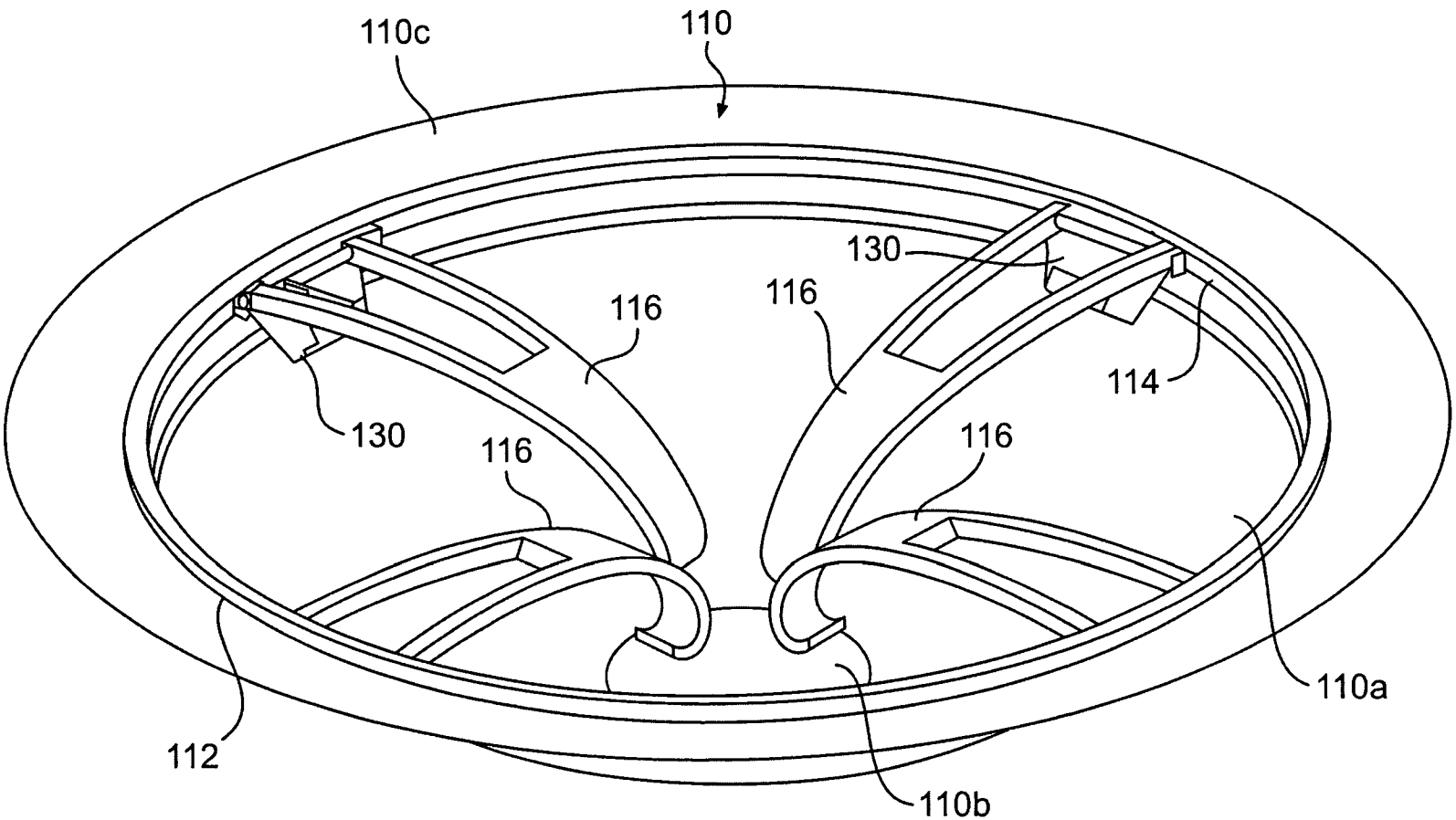
FIG. 13 is a top perspective view of the firebowl and stand assembly of FIGS. 9 to 12, showing the inoperative, stowed state of the stand.

Referring to FIG. 13, legs 116 are shown in the folded, stowed positions thereof within firebowl 110, with stand 12, including ring 114, being fully received within firebowl 110.

Figure 14:
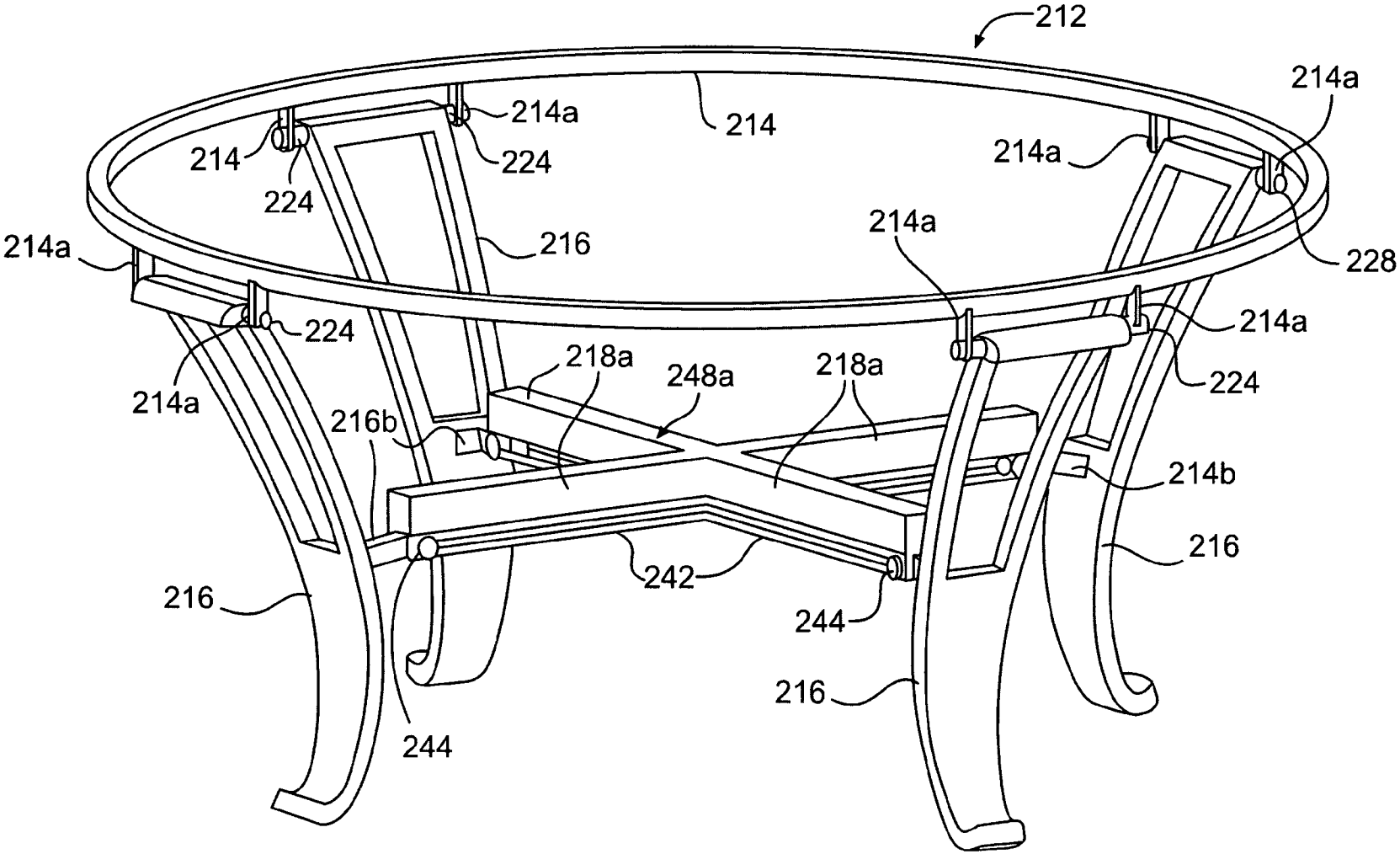
FIG. 14 is a perspective view of a stand in accordance with another preferred embodiment of the invention.
Figure 15:
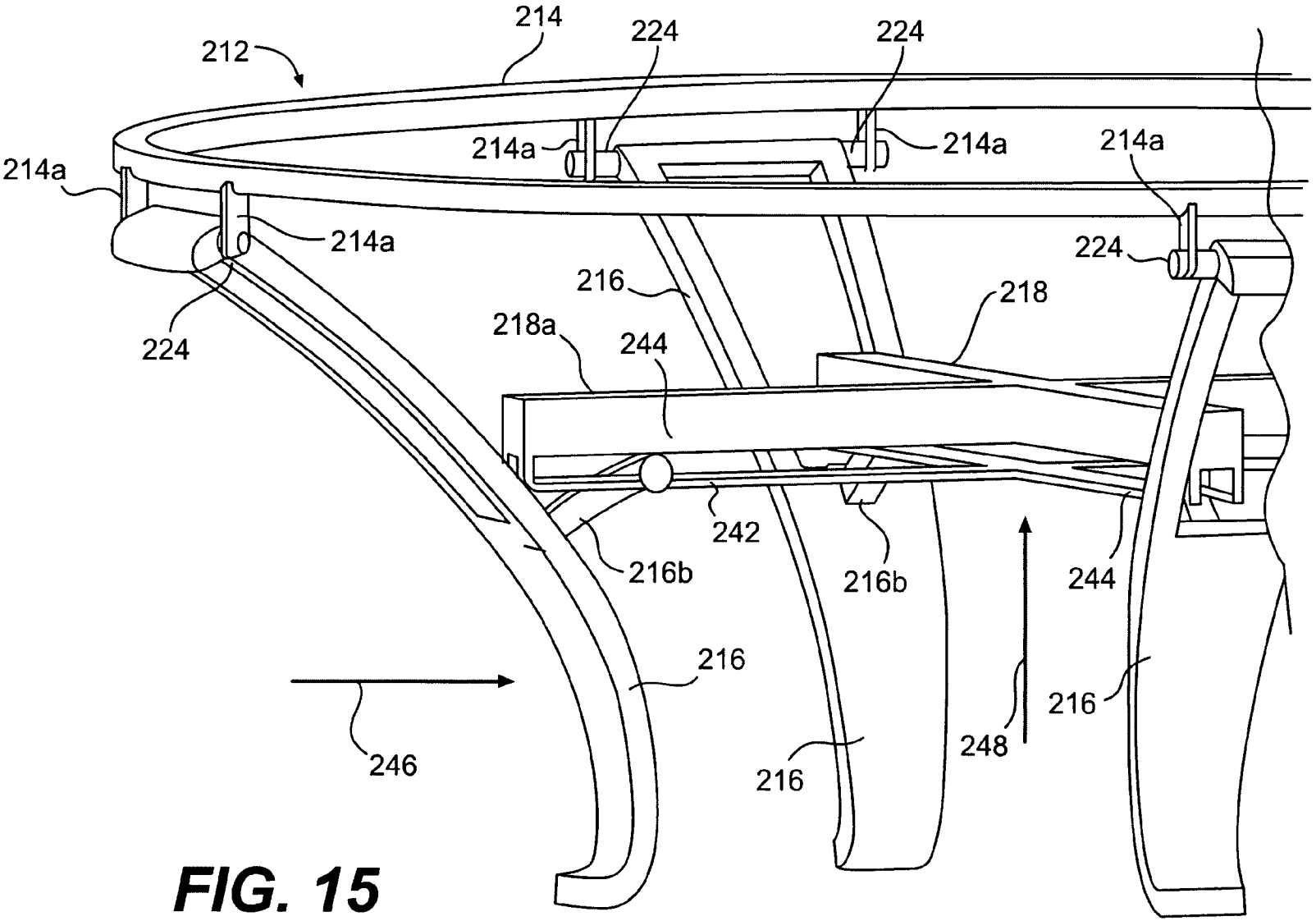
FIG. 15 is a partially broken away perspective view of the stand of FIG. 14, showing details thereof.
Figure 16:
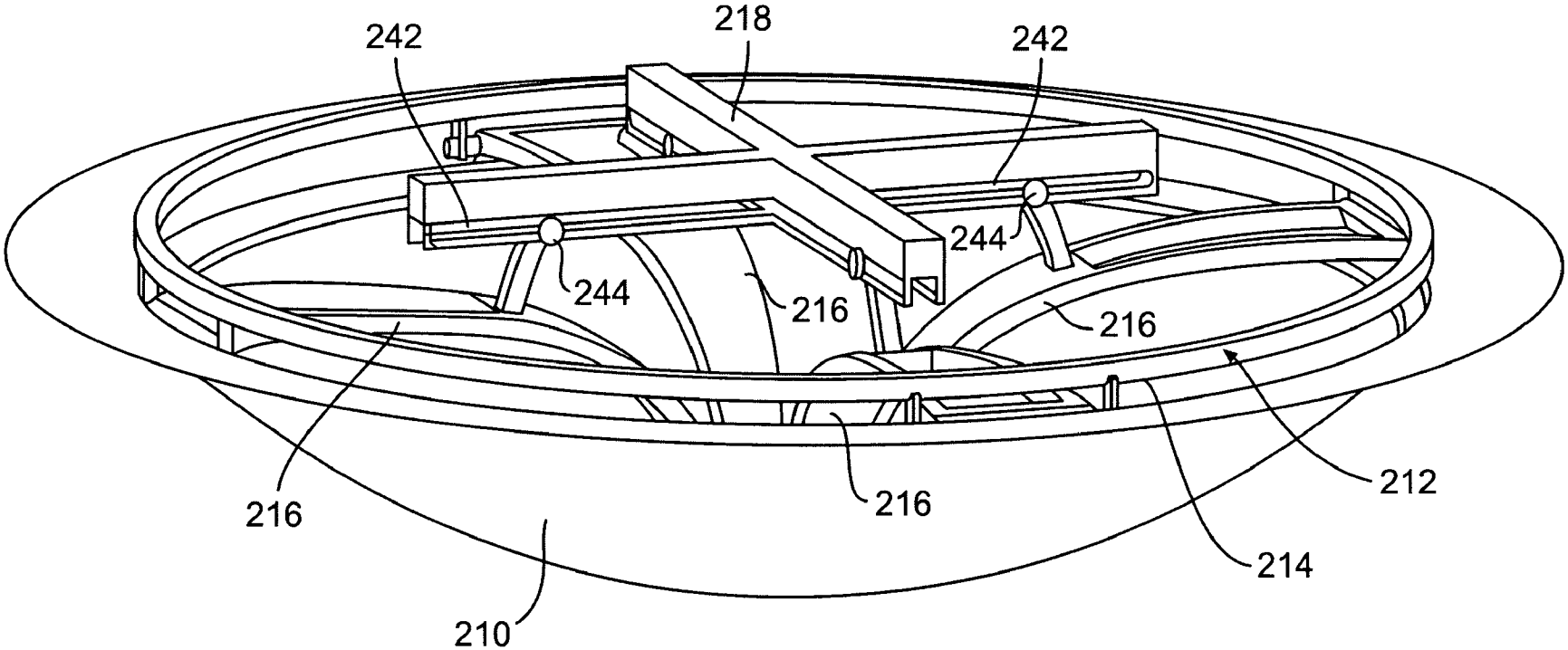
FIG. 16 is a top perspective view of a firebowl and stand assembly including the stand of FIGS. 14 and 15, showing the stand in the folded or collapsed state thereof, and as received for storage in a firebowl corresponding to that of FIG. 1.

Turning now to FIGS. 14 to 16, a further preferred embodiment is shown. Again, the basic firebowl is the same and the stands are similar in all of the embodiments, and corresponding or like elements in FIGS. 14 to 16 have been given the same reference numerals as in FIGS. 1 to 8 preceded by a "2" so that the firebowl of FIGS. 14 to 16 is denoted 210 and the stand is denoted 212.

The embodiment of FIGS. 14 to 16 is similar to that of FIGS. 1 to 8 in that a cross member is used in both embodiments, but in the embodiment of FIGS. 14 to 16, the arms 218*a* of cross member 218 each include a lower slotted track or slot 242 extending along the length thereof and adapted to receive a laterally projecting headed portion or support element 244 located at the free end of associated connector elements 216*b* of the corresponding leg 216. Headed portion 244*a* extends laterally outwardly from connector element 216*b* on opposite sides thereof and rides along the corresponding slot 242 during pivoting movement of the associated leg 216. The legs 216 are similar to those of FIGS. 1 to 8 and the upper ends thereof pivot, around pivot pins 224 supported by elements 214*a* of ring 214, between the erected, operative positions thereof and the folded, inoperative positions thereof.

In operation, in the erected positions thereof, legs 116 are pivoted to the end positions shown in FIG. 14 and held there by the simple frictional engagement between the headed portions 244 of connecting elements 216*b* of legs 216 and the corresponding portions of an associated cross arm 218*a* that form the distal end of track or slot 242.

Referring to FIG. 15, to fold the stand for storage, legs 116 are pivoted inwardly as indicated by arrow (movement vector) 246, so that the headed portions 244 of connector elements 216*b* slide along the corresponding track or slot 242 and cross member 218 moves upwardly as indicated by arrow (movement vector) 248.

Referring to FIG. 16, stand 212 is shown as being stored or stowed in firebowl 210 and, in this state, the legs 216 are, as shown, in their fully folded positions and are received in firebowl 210. Cross member 218 is supported by legs 216 through connector elements 216*b*, the headed portions 242 of which are received in corresponding tracks of slots 242 of legs 216.

Figure 17:
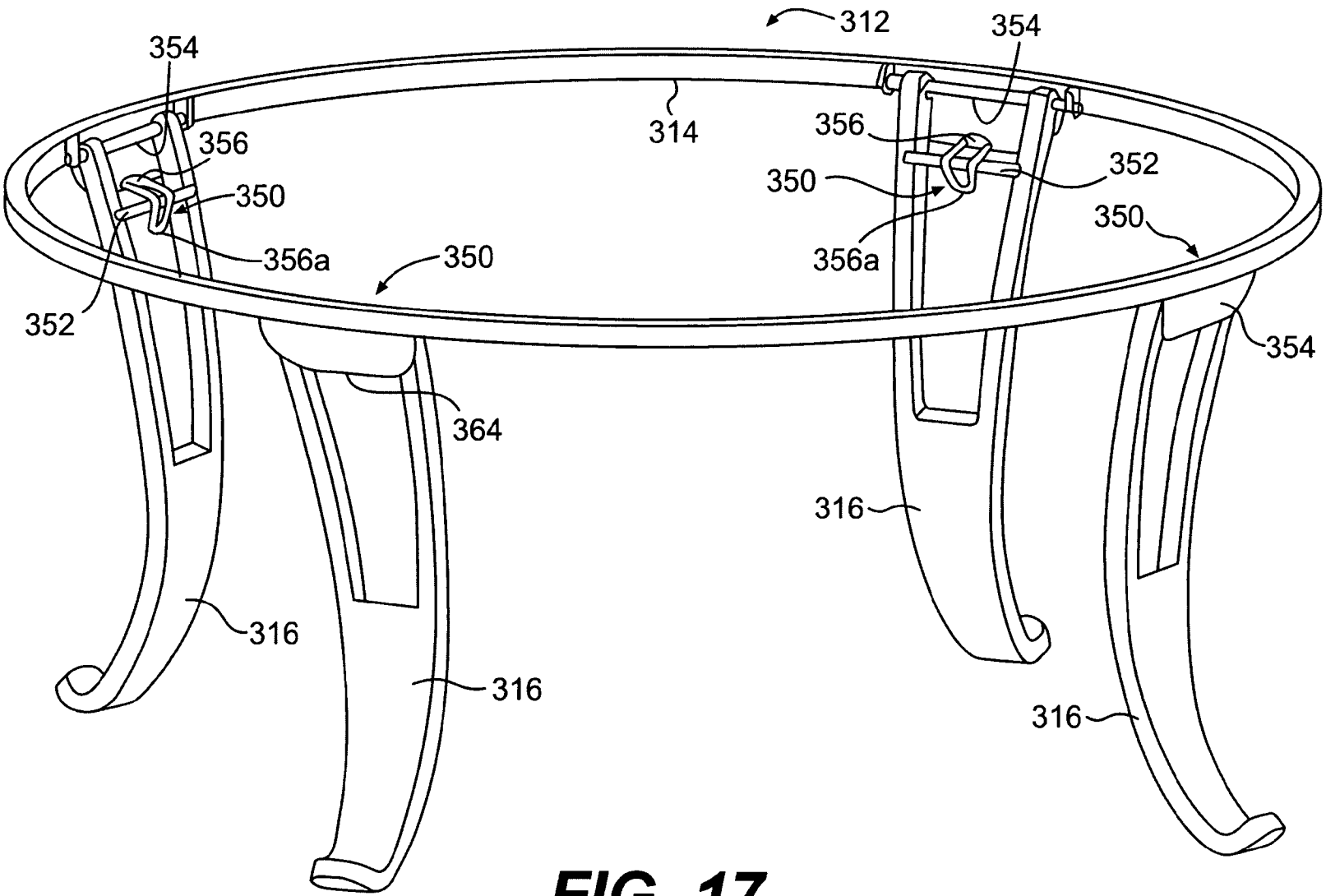
FIG. 17 is a perspective view of a stand in accordance with yet another preferred embodiment of the invention, in the operative, erected state thereof.
Figure 18:
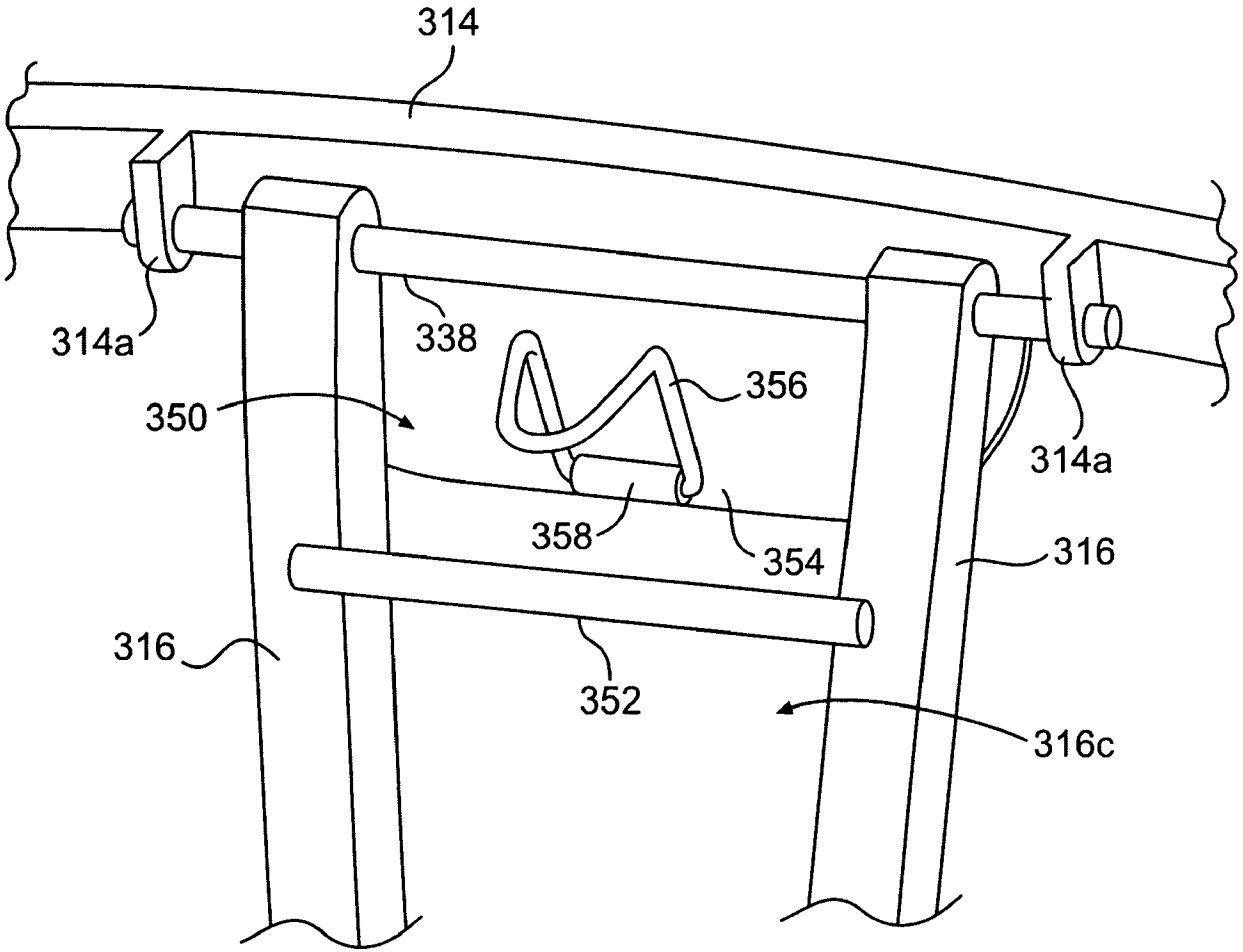
FIG. 18 is a partially broken away perspective view of the stand of FIG. 17, showing details of a latching mechanism.
Figure 19:
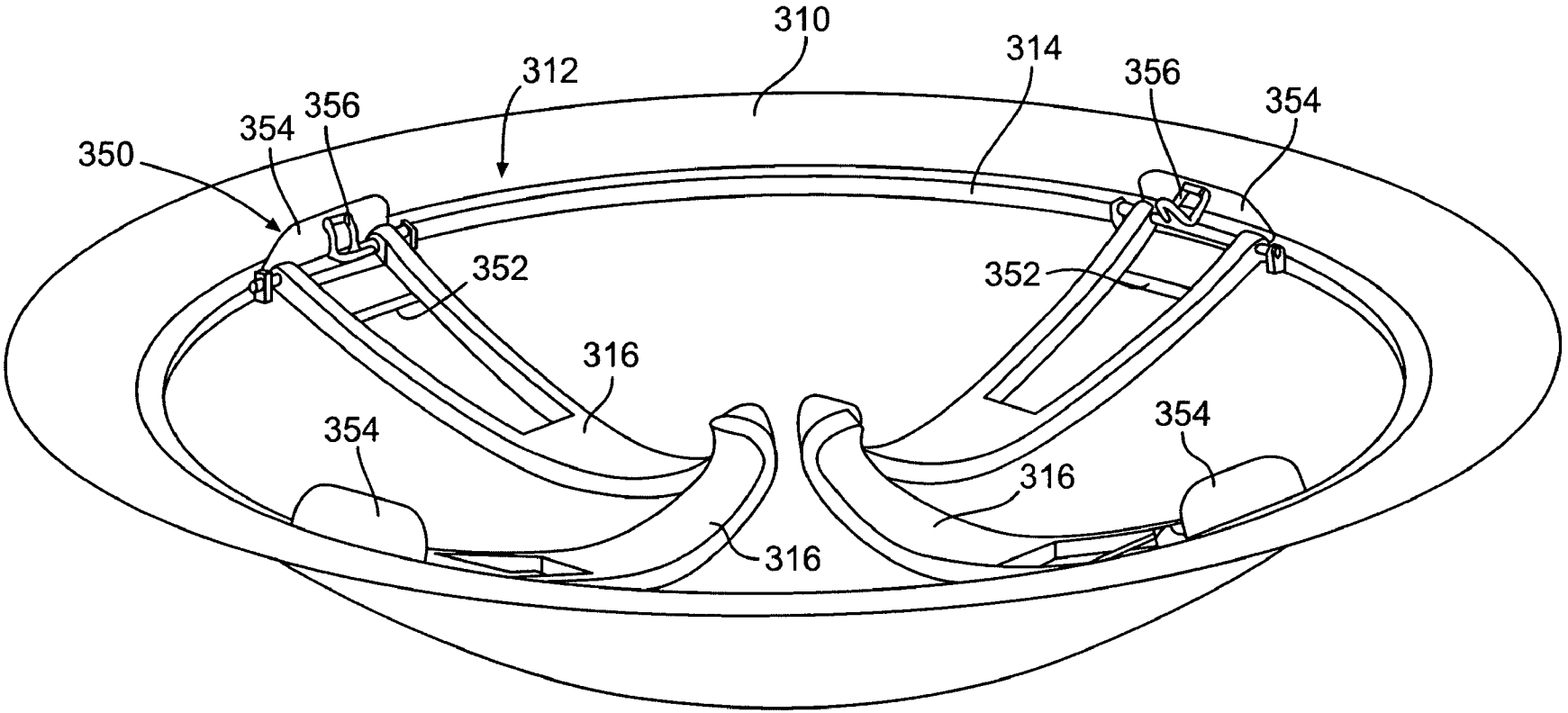
FIG. 19 is a top perspective view of a firebowl and stand assembly, showing the stand of FIGS. 17 and 18, showing the stand in the folded state thereof, and as received for storage in a firebowl corresponding to that of FIG. 1.

Turning now to yet another preferred embodiment, and referring to FIGS. 17 to 19 wherein elements corresponding to or similar to those of FIGS. 1 to 8 are given the reference numerals preceded by a "3" so the firebowl is denoted 310 and the stand is denoted 312, in this embodiment, a latching mechanism 350 is employed which, similarly to the embodiment of FIGS. 9 to 13, provides for latching the legs 316 to the ring 314 in the operative, erected state of stand 312. This state is illustrated in FIG. 17.

The latching mechanism 350 is perhaps best seen in FIG. 18. In this embodiment, a latching member or bar 352 is provided on each leg 316 and, as illustrated, extends between the portions of leg 316 which define opening 316*c*. Each leg 316 is pivotably mounted at the upper or proximal end thereof to ring 314, as in the other embodiments, and, in the implementation illustrated, similarly to the embodiment of FIGS. 9 to 13. Specifically, leg 316 is mounted for pivoting around a pivot member 338 received in support elements 314*a* of ring 314.

The latching mechanism 350 also includes a downwardly depending support plate 354 secured to ring 314 which supports a pivotable latch member or latch 356 mounted for rotation or pivoting in a pivot mount secured to plate 354. As illustrated, latch 356 includes central U-shaped portion 356*a* and a pair of legs 356*b* having inturned ends which pivot within pivot mount 358. As shown in FIG. 17, in the latched position thereof, central portion 356*a* of latch 356, which is of a spring-like construction, fits over bar 352 so as to latch the corresponding leg 316 in place.

To release the latching mechanism 350, latch 356 is simply forced out of engagement with bar 352 so that the corresponding leg 316 is again free to pivot. Thus, legs 316 can be moved to the folded or stowed position shown in FIG. 19, and stand 312 can again be stowed or stored within firebowl 310, as illustrated in FIG. 19.

Figure 20:
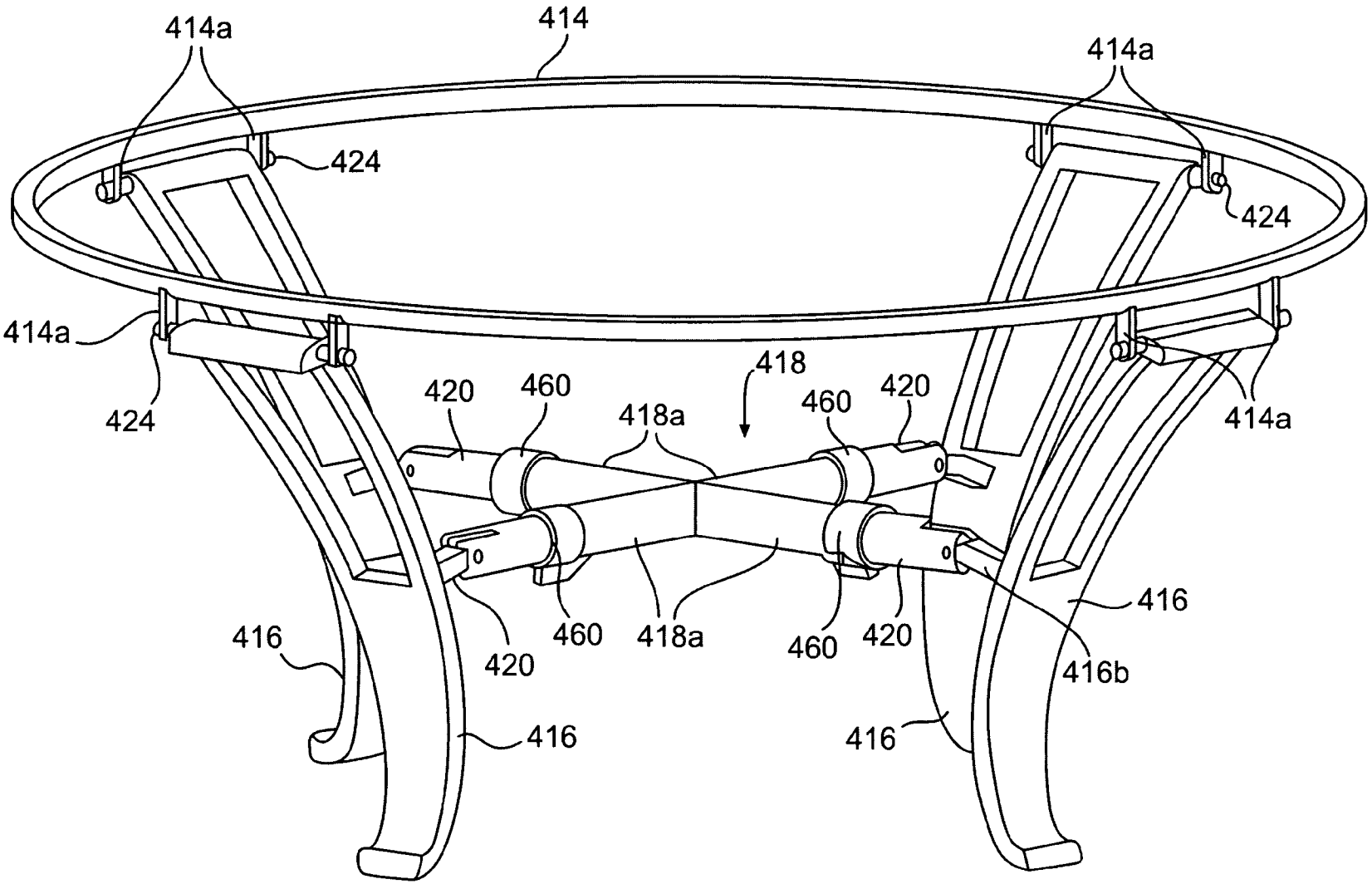
FIG. 20 is a perspective view of a stand in accordance with a further preferred embodiment of the invention, in the erected state thereof.
Figure 21:
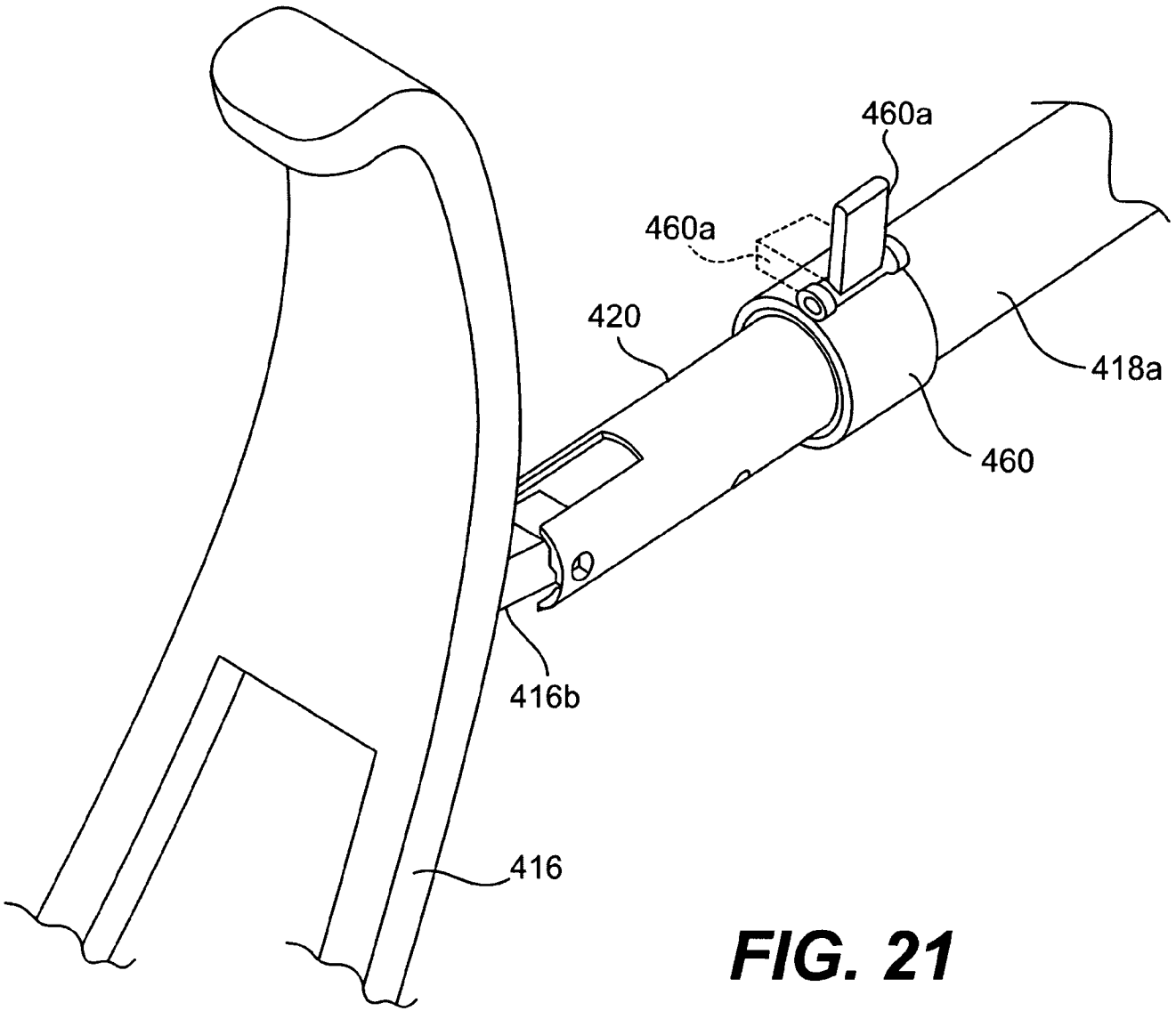
FIG. 21 is a perspective view of a detail of the stand of FIG. 20.
Figure 22:
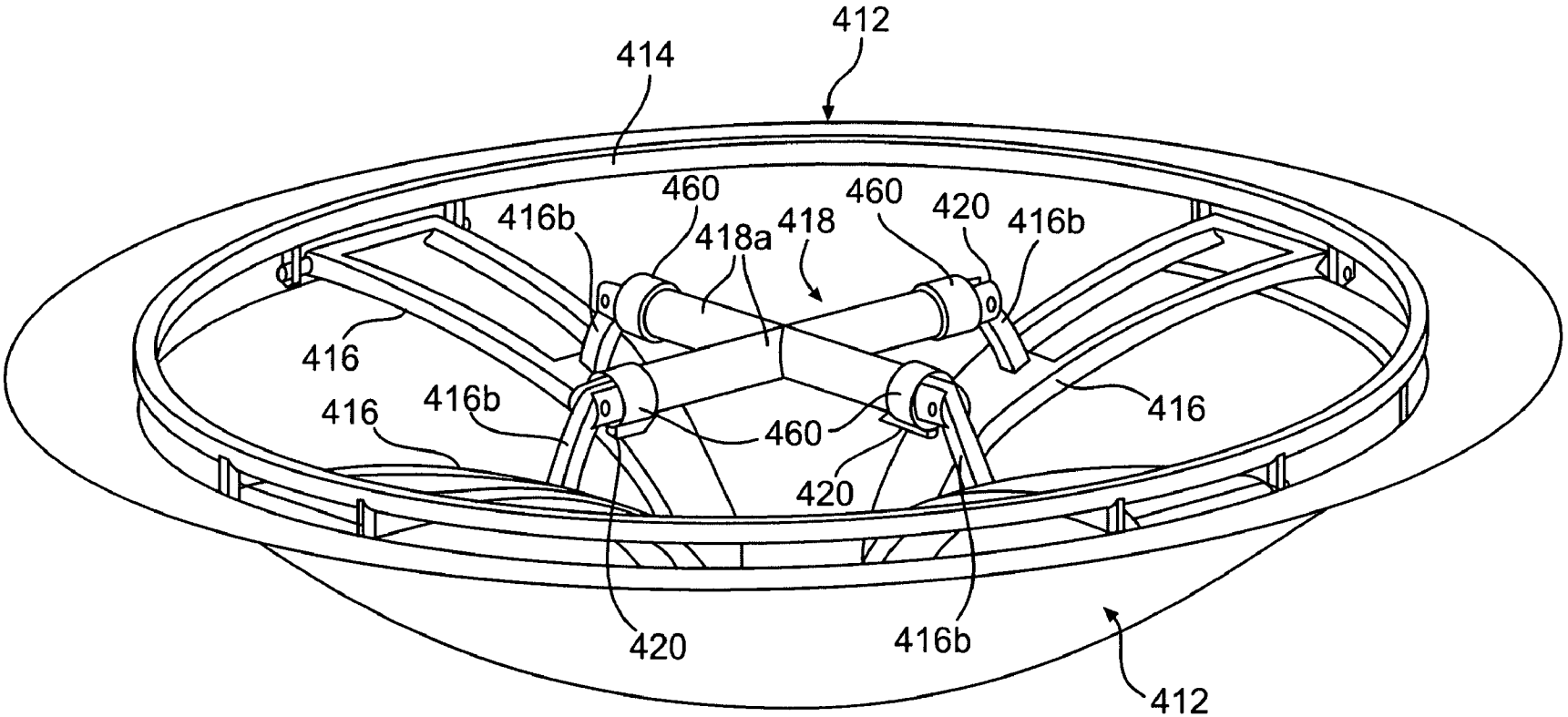
FIG. 22 is a top perspective view of a firebowl and stand assembly including the stand of FIGS. 20 and 21, showing the stand in the folded sate thereof and as received in a firebowl corresponding to the firebowl of FIG. 1.

Referring now to FIGS. 20 to 22, there is shown yet another preferred embodiment of the invention. This embodiment is similar to the embodiment of FIGS. 1 to 8, and corresponding or like elements have been given the same reference numerals preceded by the numeral "4" so that the firebowl is denoted 410 and the stand is denoted 412.

As illustrated, the embodiment of FIGS. 20 to 22 includes a cross member 418 which, in the illustrated implementation, has cylindrical arms 418*a*. The folding and erecting mechanism is similar to that of FIGS. 1 to 8, and legs 416 similarly include outwardly projecting connector or support elements 416*b* which are pivotably connected to respective sliders 420 which slide within the associated arms 418*a*. The most important difference between the two embodiments is that the embodiment of FIGS. 20 to 22 includes a cylindrical clamping member or circle clamp 460 for each arm 418*a* which is used for controlling clamping and release of the corresponding slider 420.

Considering the clamps 460 in more detail, referring to FIG. 21, a typical clamp 460 is shown disposed at the free end of the associated arm 418*a* of cross member 418 and extending completely around that end. Claim 460 is of a generally conventional construction per se, and includes a clamping control element 460*a* which controls tensioning of clamp 460. Control element 460*a*, in the tangential position shown in dashed lines, provides tightening of clamp 460 around slider 420 so as to prevent movement thereof. In the upright, release position of control element 460*a* shown in solid lines, the tension on clamp 460 is released so that the clamping forces on slider 420 are also released. Thus, slider 420 is free to slide and to thereby allow pivoting of leg 416 as described above in connection with the embodiment of FIGS. 1 to 8. In this regard, as in the latter embodiment, slider 420 of the embodiment of FIGS. 20 to 22 is pivotably connected to support element 416*b* of leg 416, and leg 416 is pivotably connected to ring 414.

As shown in FIG. 22, when clamps 460 are released, legs 416 can be pivoted to the fully folded positions thereof and stand 412 can be nested or otherwise positioned within firebowl 410.

Although the invention has been described above in relation to preferred embodiments thereof, it will be understood by those skilled in the art that variations and modifications can be effected in these preferred embodiments without departing from the scope and spirit of the invention.

What is claimed:

1. An erectable and stowable decorative firebowl and stand assembly comprising:

a firebowl; and a stand having a first, erected state wherein the stand supports the firebowl and a second, folded state wherein the stand is adapted to be received within the firebowl, said stand including a support ring for supporting the firebowl in the first state of the stand, a plurality of legs pivotably connected to the ring and pivotable between (i) an erected state in the first state of the stand and (ii) a folded state in the second state of the stand, and a control mechanism for controlling pivoting of the legs;

wherein said control mechanism includes a latch for releasably latching the legs to the ring so as to prevent pivoting movement of the legs;

wherein said latch comprises a pivotable latch arm movable between a first, latching position and a second, inoperative position;

wherein said support ring includes a depending mounting plate; and wherein said mounting plate carries an L-shaped support element comprising a connecting portion and a mounting portion, and wherein said latch arm has a gripping element at one end thereof and is pivotably mounted at the other end thereof to pivot about a pivot point located at one end the mounting portion of the L-shaped support element.

2. In combination, a decorative firebowl and a stand for the firebowl, said stand having a first, erected state wherein the stand supports the firebowl and a second, folded state wherein the stand is adapted to be received within the firebowl, and said stand including a support ring for supporting the firebowl in the first state of the stand, and a plurality of legs pivotably connected to the ring and pivotable between (i) an erected state in the first state of the stand and (ii) a folded state in the second state of the stand;

wherein the stand further comprises a latch for releasably latching the legs to the ring so as to prevent pivoting movement of the legs;

wherein said latch comprises a pivotable latch arm movable between a first, latching position and a second, inoperative position;

wherein said support ring includes a depending mounting plate; and wherein said mounting plate carries an L-shaped support element comprising a connecting portion and a mounting portion, and wherein said latch arm has a gripping element at one end thereof and is pivotably mounted at the other end thereof to pivot about a pivot point located at one end the mounting portion of the L-shaped support element.

3. An erectable and stowable decorative firebowl and stand assembly, said assembly comprising:

a firebowl; and a stand having a first, erected state wherein the stand supports the firebowl and a second, stowable state wherein the stand is adapted to be received within the firebowl for storage therewith, said stand including a support ring for supporting the firebowl in the first state of the stand, a plurality of legs pivotably connected to the ring and pivotable between (i) an erected state in the first state of the stand and (ii) a folded state in the second state of the stand, said ring being of a size relative to the firebowl so as to be fully accommodated within the firebowl in the second, stowable state of the stand;

wherein the stand further comprises a latch for releasably latching the legs to the ring so as to prevent pivoting movement of the legs;

wherein said latch comprises a pivotable latch arm movable between a first, latching position and a second, inoperative position;

wherein said support ring includes a depending mounting plate; and wherein said mounting plate carries an L-shaped support element comprising a connecting portion and a mounting portion, and wherein said latch arm has a gripping element at one end thereof and is pivotably mounted at the other end thereof to pivot about a pivot point located at one end the mounting portion of the L-shaped support element.

* * * * *